US011120230B2

(12) United States Patent
Tsividis

(10) Patent No.: US 11,120,230 B2
(45) Date of Patent: Sep. 14, 2021

(54) ANALOG COMPUTING USING DYNAMIC AMPLITUDE SCALING AND METHODS OF USE

(71) Applicant: SENDYNE CORPORATION, New York, NY (US)

(72) Inventor: Yannis Tsividis, New York, NY (US)

(73) Assignee: Sendyne Corporation, New York, NY (US)

( * ) Notice: Subject to any disclaimer, the term of this patent is extended or adjusted under 35 U.S.C. 154(b) by 0 days.

(21) Appl. No.: 15/733,014

(22) PCT Filed: Sep. 19, 2019

(86) PCT No.: PCT/IB2019/057888
§ 371 (c)(1),
(2) Date: Dec. 29, 2019

(87) PCT Pub. No.: WO2020/058885
PCT Pub. Date: Mar. 26, 2020

(65) Prior Publication Data

US 2020/0265198 A1 Aug. 20, 2020

Related U.S. Application Data

(60) Provisional application No. 62/704,020, filed on Sep. 20, 2018.

(51) Int. Cl.
*G06G 7/18* (2006.01)
*G06G 7/161* (2006.01)
*G06G 7/66* (2006.01)

(52) U.S. Cl.
CPC ..... *G06G 7/161* (2013.01); *G06G 7/18* (2013.01); *G06G 7/66* (2013.01)

(58) Field of Classification Search
CPC ..... G06F 30/36; G06F 30/373; G06G 7/18; G06G 7/38
(Continued)

(56) References Cited

U.S. PATENT DOCUMENTS 5,731,769 A * 3/1998 Girardeau, Jr. ..... H03M 3/462 341/61
6,614,286 B1 * 9/2003 Tang ..... G06G 7/184 327/337
(Continued)

FOREIGN PATENT DOCUMENTS

KR 101726582 B1 4/2017
KR 20170131380 A 11/2017

OTHER PUBLICATIONS

International Search Report in application No. PCT/IB2019/057888, dated Dec. 26, 2019.
(Continued)

*Primary Examiner* — Matthew D Sandifer
(74) *Attorney, Agent, or Firm* — Oppedahl Patent Law Firm LLC

(57) ABSTRACT

An improved integrator for use in physical analog-computing systems is disclosed, featuring real-time dynamic amplitude scaling schemas that make use of an injected correction factor responsive to a contemporaneous change in an input dynamic-amplitude-scaling compensation factor. The injected correction factor is designed to reduce or eliminate transient output perturbations due to the amplitude scaling change. The disclosures discussed have real-world applications for physical analog computers and hybrid computers used to control and manage many types of industrial-control systems.

28 Claims, 14 Drawing Sheets

(58) Field of Classification Search
USPC ..... 708/823, 827
See application file for complete search history.

(56) References Cited

U.S. PATENT DOCUMENTS

| | | | | |
|---|---|---|---|---|
| 6,961,746 | B1 * | 11/2005 | Tang | G06G 7/18 708/823 |
| 9,778,074 | B2 * | 10/2017 | Schulte | G01D 5/24 |
| 2006/0187098 | A1 | 8/2006 | Suetake | |
| 2013/0106487 | A1 * | 5/2013 | Gupta | H03H 11/1252 327/339 |
| 2013/0297665 | A1 | 11/2013 | Nikitin | |
| 2014/0145759 | A1 * | 5/2014 | Tsividis | G06G 7/1865 326/52 |
| 2014/0354343 | A1 | 12/2014 | Ziemba | |
| 2018/0013410 | A1 | 1/2018 | Yang | |
| 2018/0026608 | A1 * | 1/2018 | Yang | H03H 11/126 327/356 |

OTHER PUBLICATIONS

Written Opinion in application No. PCT/IB2019/057888, dated Dec. 26, 2019.

* cited by examiner

ANALOG COMPUTING USING DYNAMIC AMPLITUDE SCALING AND METHODS OF USE

CROSS-REFERENCE TO RELATED APPLICATIONS

This patent application claims the priority benefit of U.S. patent application Ser. No. 62/704,020, filed on Sep. 20, 2019 for "Dynamic Amplitude Scaling in the Analog Computer." Further, this patent application hereby incorporates by reference U.S. Patent Application No. 62/704,020 for all purposes.

BACKGROUND

This patent application directs itself to physical analog computers. By this we mean computers that carry out computations by means of analog electrical circuitry that manipulates analog electrical signals, typically for the purpose of solving differential equations. Importantly, such computers are better suited in many ways than are digital computers for solving nonlinear differential equations. There was a time before digital computers became popular that analog computers were widely used for computation. When digital computers became popular, only a much smaller fraction of computation took place by means of analog computation. But in very recent times, perceptive investigators have come to appreciate that for certain types of real-life situations, it can be very helpful to make use of analog computation, often in a computational system that includes both a digital computer and an analog computer. This has, in very recent times, prompted perceptive investigators to try to think of ways to do analog computation better or faster or more accurately or less expensively or in a smaller form factor or with greater dynamic range or with better bandwidth or with the ability to handle more complex mathematical computations.

Such hybrid computation has proven to be particular powerful for at least two categories of work: sophisticated simulation of systems, and sophisticated control and management of real-life systems.

A hasty reader might assume that what is being discussed is a digital simulation of analog circuitry, or a digital simulation of analog phenomena. Such is not the present discussion. What is being discussed is actual analog circuitry, such as integrators and amplifiers and other elements that make up analog computers, working alongside a digital computer. The challenges being described and, hopefully, solved are physical challenges of physical electrical voltages and currents, not mental steps.

One particular challenge, as just mentioned, is the "dynamic range" challenge. Real-life signals often come into existence that have any of a wide range of electrical values. In contrast, any particular analog computer will necessarily have some limit on the range of electrical signal values that can be fed into it as inputs. In an exemplary analog computer the circuitry will be designed to permit input values to range between −10 volts and +10 volts. A person who is learning for the first time to make use of an analog computer will encounter this situation and will learn to "scale" the incoming analog signal. In a simple situation the signal to be received might have a fairly predictable range of values, say −20 volts to +20 volts. In such a simple situation it is easy to think what to do, namely to use a simple voltage divider to cut the voltage in half. When the user is selecting a voltage divider for such scaling, the user will hope to avoid either of two blunders—scaling too much or scaling too little. Scale too much, and the signal of interest will be of too small an amplitude and will risk being overwhelmed by other noise sources. At the very least, any overscaling has the consequence of making the signal-to-noise ratio worse than it would otherwise have needed to be. Scale too little, and the signal of interest, even after scaling, may exceed the permitted input levels of the analog computer circuitry. This leads to distortion and inaccuracy. In extreme cases an out-of-limit input might even damage the analog computer circuitry.

As mentioned above, in a simple situation the signal to be received might have a fairly predictable range of values. Experience shows, however, that some real-life applications lead to situations where some signal of interest is not so predictable. The voltage divider that might make sense at one time, or under one external condition, might fail to make sense at some other time, or under some other external condition.

Analog computers are thus slowly coming to be used in some real-world systems to assist in solving arbitrary mathematical problems in real time, as they can sometimes lead to faster or lower-energy means to achieve a solution than digital computers used alone. However, because the real-world inputs (values) to analog computers can sometimes vary widely, if the input signals are not properly constrained to be within the design limits of a physical electronic analog computer, the ability of an analog computer to process the input signals into a meaningful output is compromised. If a signal that needs to be processed by the physical analog computer is too large, it could become distorted. Conversely, if a signal that needs to be processed by the physical analog computer is too small, it could get swamped by noise.

The situation to be addressed is that changes in the magnitude of an input signal to the analog computer might prompt changing a scaling factor from time to time. In a nondemanding classroom situation, for example, when such a magnitude change were to happen, one might simply turn off the analog computation, change the scaling factor, and then start analog computation again.

But in today's world analog computers are used in demanding real-life situations in which the analog computations need to be carried on continuously. This might be because the system needs to continuously carry out control of a physical system. Or this might be because the system is carrying out a simulation over time, in which it is desired that the computations be carried out throughout the time of the simulation. In any of these situations, there is a big problem in that a change in a scaling factor at an input is likely to give rise to very undesirable perturbations in downstream signals, for example downstream of some integrator that is itself downstream of the input that we are talking about.

What is needed is a simple yet robust means to somehow permit changes in scaling factors even in the midst of analog computation that is intended to be continuous, and somehow dealing with this perturbation problem.

BRIEF SUMMARY

The inventive disclosures described herein pertain to improved physical analog computers and integrators that employ dynamic amplitude scaling in order to reduce or eliminate analog-computer output distortions and input-signal-to-noise ratios in real-world applications. The basic schemas provide for detecting when an input signal range is not optimum for the analog-computing environment, then strategically introducing an input dynamic-amplitude-scaling compensation factor in response to an input-signal while the physical analog computer is in service in order to ensure that said input signal's range is constrained to be within the design limits of said physical analog computer, whereby the introduction of said dynamic-amplitude-scaling compensation factor reduces system-output distortion and improves the signal-to-noise ratio. The schema also provides for introducing an output dynamic-amplitude-descaling compensation factor at the output of said physical analog computer in order to prepare the analog computer output for presentation to a system user. In variations, the schema incorporates an improved integrator that is adapted to receive a one-time correction factor in input amplitude responsive to an imminent change in the input dynamic-amplitude-scaling compensation factor, which is designed to counteract any transient output perturbations due to the introduction of a dynamic-amplitude-scaling compensation factor and to ensure that the output of the improved physical analog computer is better than without said one-time correction factor.

The foregoing Brief Summary is intended to merely provide a short, general overview of the inventive disclosure described throughout this patent application, and therefore, is not intended to limit the scope of the inventive disclosure contained throughout the balance of this patent application, including any appended claims and drawings.

BRIEF DESCRIPTION OF THE DRAWINGS

FIG. 2D provides two graphs of various internal signals from the system in FIG. 2A and from the system of FIG. 2C, wherein the top graph reflects no dynamic amplitude scaling and the bottom graph reflects dynamic amplitude scaling.

FIG. 5B shows the raw gain inputs (dynamic amplitude scaling), followed by FIG. 5C, which shows an embodiment of the calculation and graphical plot of a one-time transient correction factor to add to the output y of an improved analog computer output, followed by FIG. 5D, which provides an embodiment of a graph of the properly and dynamically amplitude-scaled output y of the improved analog computer.

FIG. 5G shows the raw gain inputs (dynamic amplitude scaling), followed by FIG. 5H, which shows an embodiment of the calculation and graphical plot of a one-time transient correction factor to add to the output w of an improved integrator in an analog computer improved integrator output, followed by FIG. 5I, which provides an embodiment of a graph of the properly and dynamically amplitude-scaled output y of the improved analog computer.

FIG. 6B provides a graph of an embodiment of an improved integrator (based on FIG. 6A) voltage output 104 versus time, based on a 20-kHz unity-gain frequency, a constant g=1, and a unit step input. FIG. 6C provides a graph of an embodiment of an improved integrator (based on FIG. 6A) voltage gain adjustments g, g−1 used for dynamic amplitude scaling versus time. FIG. 6D provides a graph of an embodiment of an improved integrator (based on FIG. 6A) capacitance voltage buildup w versus time during dynamic amplitude scaling.

FIG. 6E provides a graph of an embodiment of an improved integrator (based on FIG. 6A) voltage output 104 versus time, based on a 20-kHz unity-gain frequency, a constant g=1, and after a sudden dynamic amplitude scaling adjustment. FIG. 6F provides a graph of an embodiment of an improved integrator (based on FIG. 6A) voltage gain adjustments g, g−1 used for dynamic amplitude scaling versus time. FIG. 6G provides a graph of an embodiment of an improved integrator (based on FIG. 6A) capacitance voltage buildup w versus time during dynamic amplitude scaling, as well as a gain adjustment at point 111 to help deal with the "jump." Finally, FIG. 6H provides a graph of an embodiment of an improved integrator (based on FIG. 6A) depicting a largely corrected (with a minor momentary "glitch" in the center) integrator-output 104 voltage profile after application of a one-time correction factor in input amplitude responsive to an imminent change in said input dynamic-amplitude-scaling compensation factor (gain).

DETAILED DESCRIPTION

I. Overview

Figure 1A:
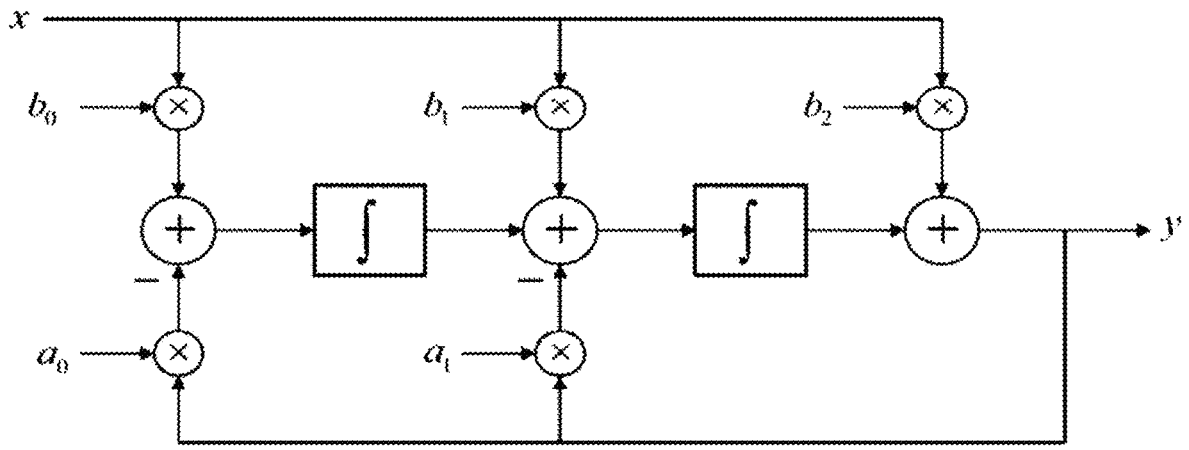
FIGS. 1A and 1B depict one simplified example of an analog computer with and without dynamic amplitude scaling, respectively, where the scaling in FIG. 1B is shown by dividing inputs $a_0$ and $b_0$ by a factor of k and a multiplicative factor k is inserted in the integrator.

Amplitude scaling can help internal signals avoid exceeding their allowable range and being buried in noise. In a sense, amplitude scaling optimizes the "dynamic range" of an analog computer. The idea is to maximize the signal-to-noise ratio for the analog paths.

The inventive disclosures described herein pertain to improved physical analog computers and integrators that employ dynamic amplitude scaling in order to reduce or eliminate analog-computer output distortions and input-signal-to-noise ratios in real-world applications. The basic schemas provide for detecting when an input signal range is not optimum for the analog-computing environment, then strategically introducing an input dynamic-amplitude-scaling compensation factor in response to an input-signal while the physical analog computer is in service in order to ensure that said input signal's range is constrained to be within the design limits of said physical analog computer, whereby the introduction of said dynamic-amplitude-scaling compensation factor reduces system-output distortion and the signal-to-noise ratio. The schema also provides for introducing an output dynamic-amplitude-descaling compensation factor at the output of said physical analog computer in order to prepare the analog computer output for presentation to a system user. In variations, the schema incorporates an improved integrator that is adapted to receive a one-time correction factor in input amplitude responsive to an imminent change in the input dynamic-amplitude-scaling compensation factor, which is designed to counteract any transient output perturbations due to the introduction of a dynamic-amplitude-scaling compensation factor and to ensure that the output of the improved physical analog computer is better than without said one-time correction factor.

It may be helpful to clarify what "one-time" means in this context. The insertion of a one-time correction factor at an integrator, to correct for a contemporaneous change in a scaling factor at an input, is a correction factor that is inserted one time in response to the scaling factor change. It does not mean that such insertion of a correction factor happens only one time during a period of time during which analog computation is taking place. Indeed the teachings of the invention contemplate that during a time when analog computation is taking place, for a particular input to the analog computer a scaling factor change might happen at one time and another scaling factor change might happen at another time. The teachings of the invention also contemplate that during a time when analog computation is taking place, for a first input to the analog computer a scaling factor change might happen at one time and for a second input to the analog computer another scaling factor change might happen, at the same time or at a different time.

II. General Technical Description of Dynamic Amplitude Scaling in an Improved Physical Analog Computer This Section II generally describes the principles underlying the use of dynamic amplitude scaling in an improved physical analog computer. Refer to FIGS. 1A through 7C.

Figure 1B:
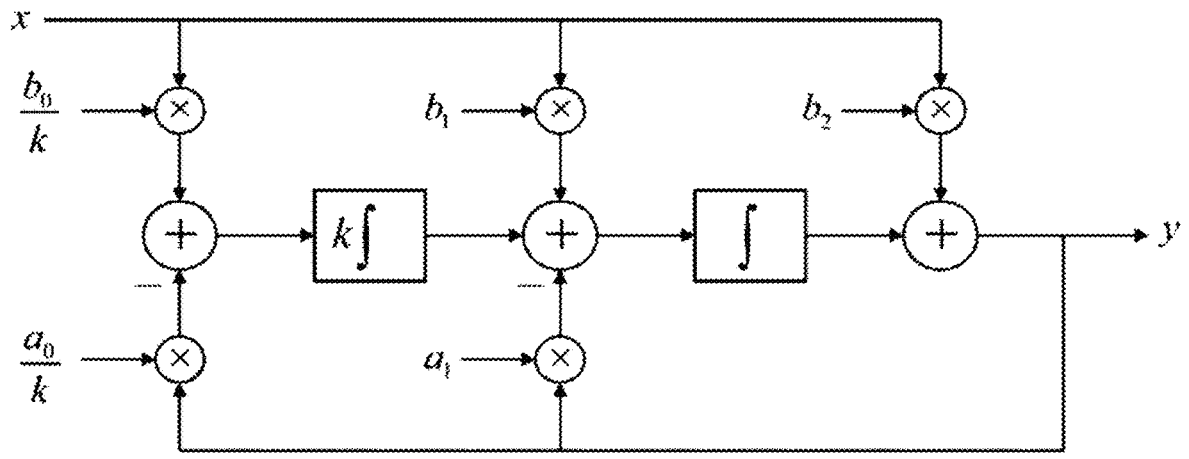

Amplitude scaling can help internal signals avoid exceeding their allowable range and being buried in noise. In a sense, amplitude scaling optimizes the "dynamic range" of an analog computer. FIGS. 1A and 1B provides a simple example: In FIG. 1A, it is assumed that the coefficients $a_0$ and $b_0$ may have values such that the output z ends up in an overload condition or ends up buried in "noise." A simple amplitude scaling of the inputs by a factor k can correct this problem. It involves those inputs, $a_0/k$ and $b_0/k$, and the input of the first integrator, $k\int$, as shown in FIG. 1B. The overall behavior at circuit points x (input) and y (output) behavior remains the same; however, the size of the affected internal signals has been changed.

Figure 2A:
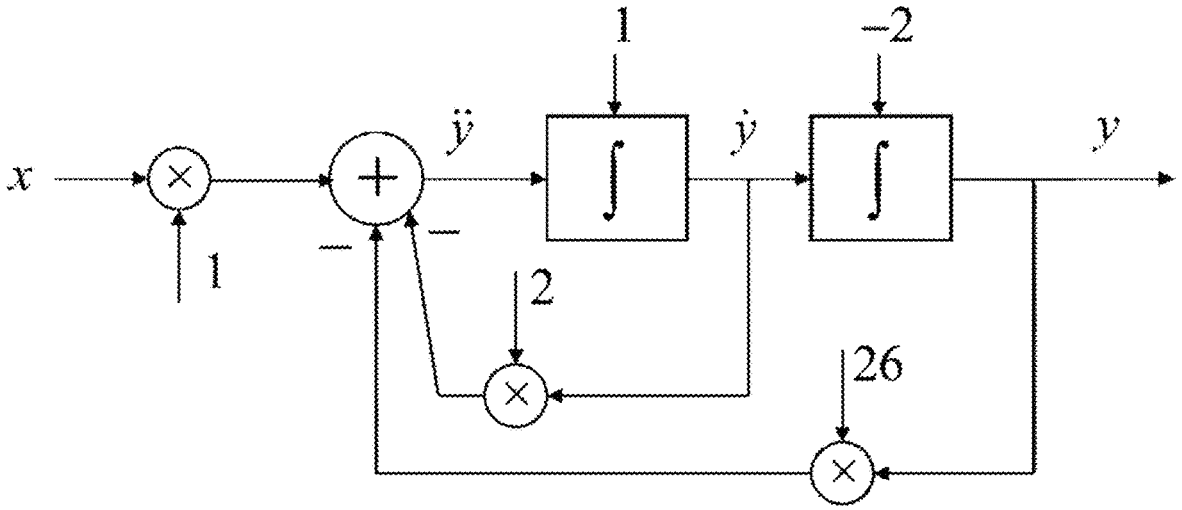
FIGS. 2A and 2B collectively depict another simple example of an analog-computing system before any amplitude scaling is applied, with FIG. 2B providing a graph of various internal signals from the system in FIG. 2A that are not subjected to dynamic amplitude scaling.
Figure 2B:
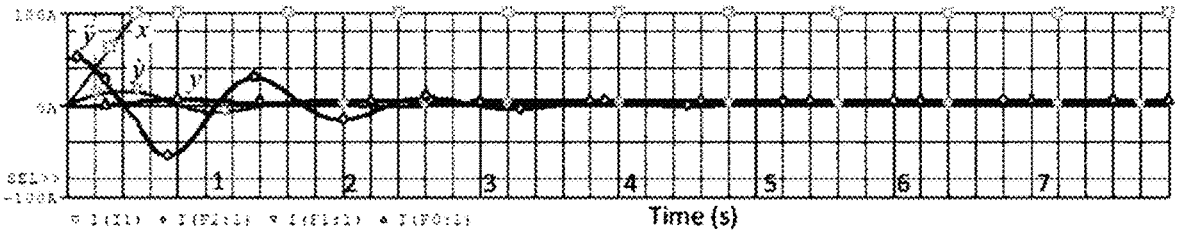

FIGS. 2A through 2D provide another simple example: The original system is depicted in FIG. 2A. As depicted in the graphs in FIG. 2B, let the forcing function x be a ramp that reaches 100 A in 0.5 s and remains 100 A thereafter. Some variables have very small magnitude and thus can be corrupted by noise. In the example contained in FIGS. 2A and 2B:

$$|x|_{max}=100A$$

$$|\dot{y}|_{max}=55.7A$$

$$|\dot{y}|_{max}=14.8A$$

$$|y|_{max}=5.8A$$

Figure 2C:
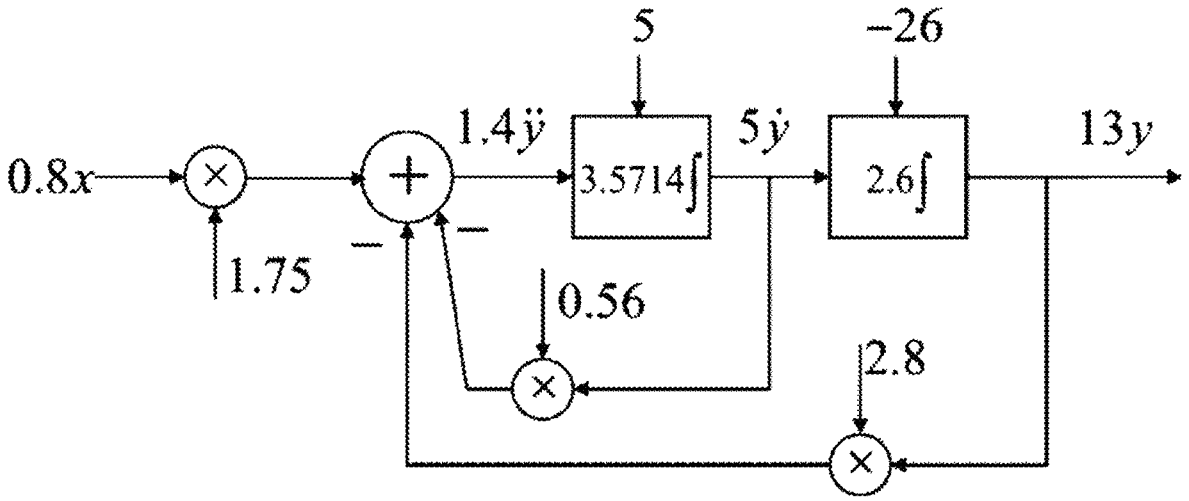
FIGS. 2C and 2D collectively depict the system in FIG. 2A, but with dynamic amplitude scaling applied, as shown by a change in the input values at key system points in FIG. 2C.
Figure 2D:
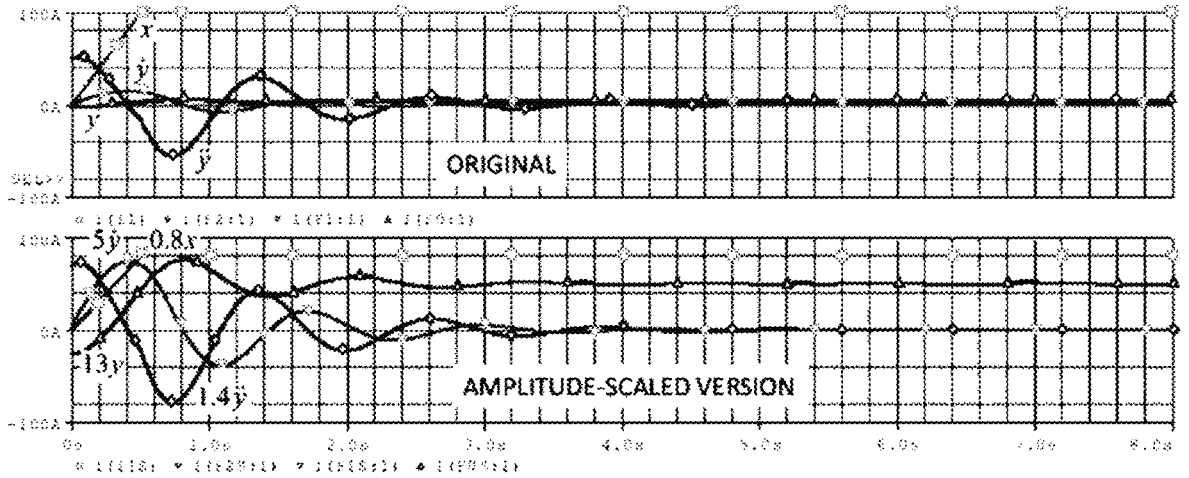

The above information, using the techniques described herein, results in the amplitude-scaled system shown in FIG. 2C. The behavior of the new amplitude-scaled system is compared to the behavior of the original system in FIG. 2D. As can be observed, all of the variables in the amplitude-scaled system have absolute values close to the maximum-allowed value (80 A), and can be expected to be well-above "noise" levels.

Following computation, the amplitude-scaled variables should be de-scaled before presentation to the system user. For example, the amplitude-scaled solution for variable y depicted in FIG. 2C and in the graphs in FIG. 2D should be divided by 13 for presentation to a system user.

The alert reader will appreciate that different types of input signals (e.g., different amplitudes or frequency content) may ideally require different scaling. If the types of input signals are known ahead of time, then the amplitude scaling can be adjusted beforehand.

Figure 3A:
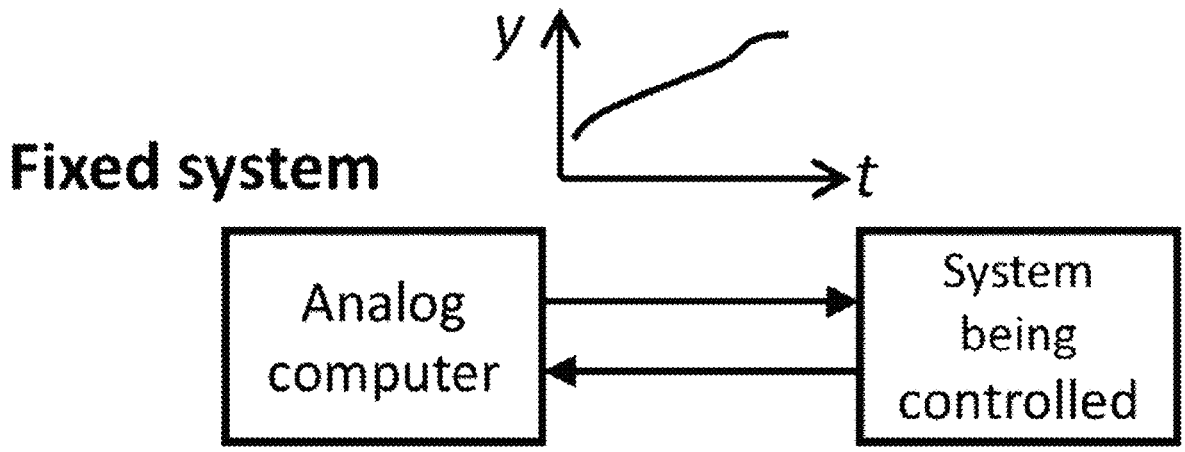
FIGS. 3A, 3B, and 3C depict simplified examples (and related output-characteristic curves), respectively, of a "fixed" (i.e., non-amplitude-scaled) analog-computing system, of a "blindly scaled" (i.e., amplitude-scaled at an arbitrary point in time) analog-computing system, and of a "properly" dynamically amplitude-scaled) analog-computing system.
Figure 3B:
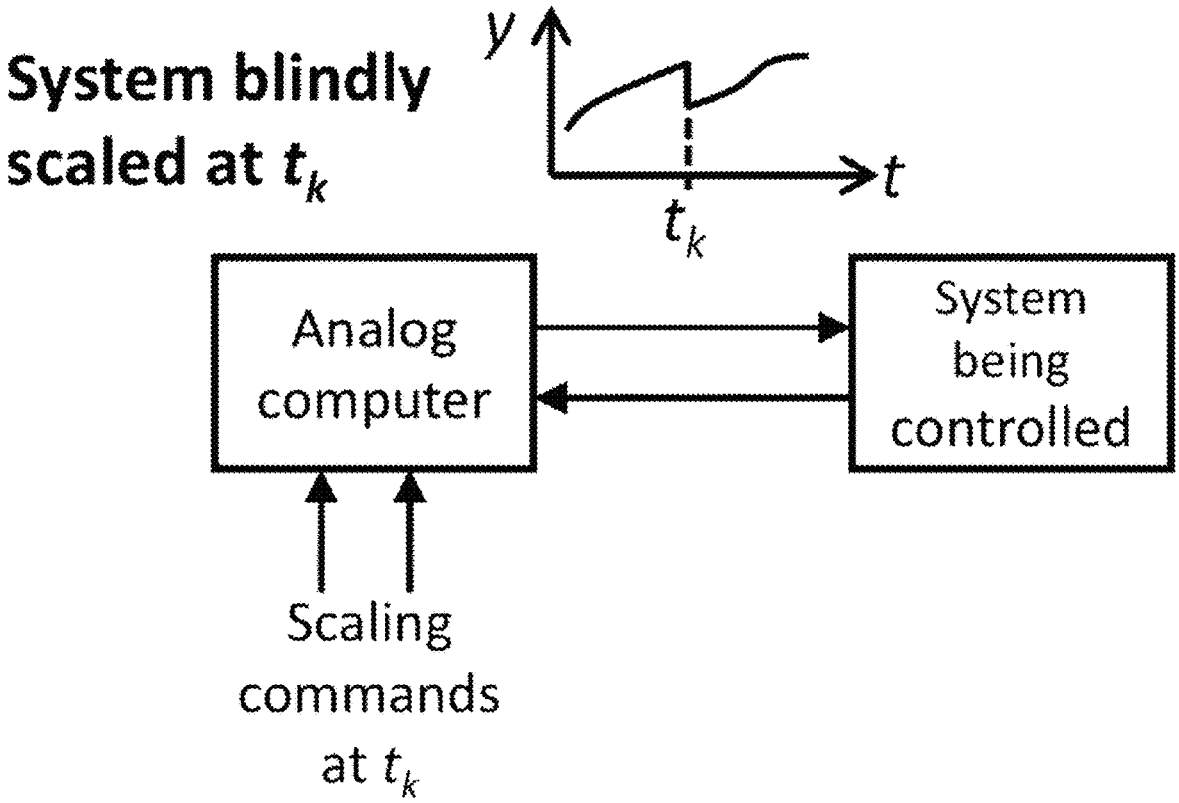
Figure 3C:
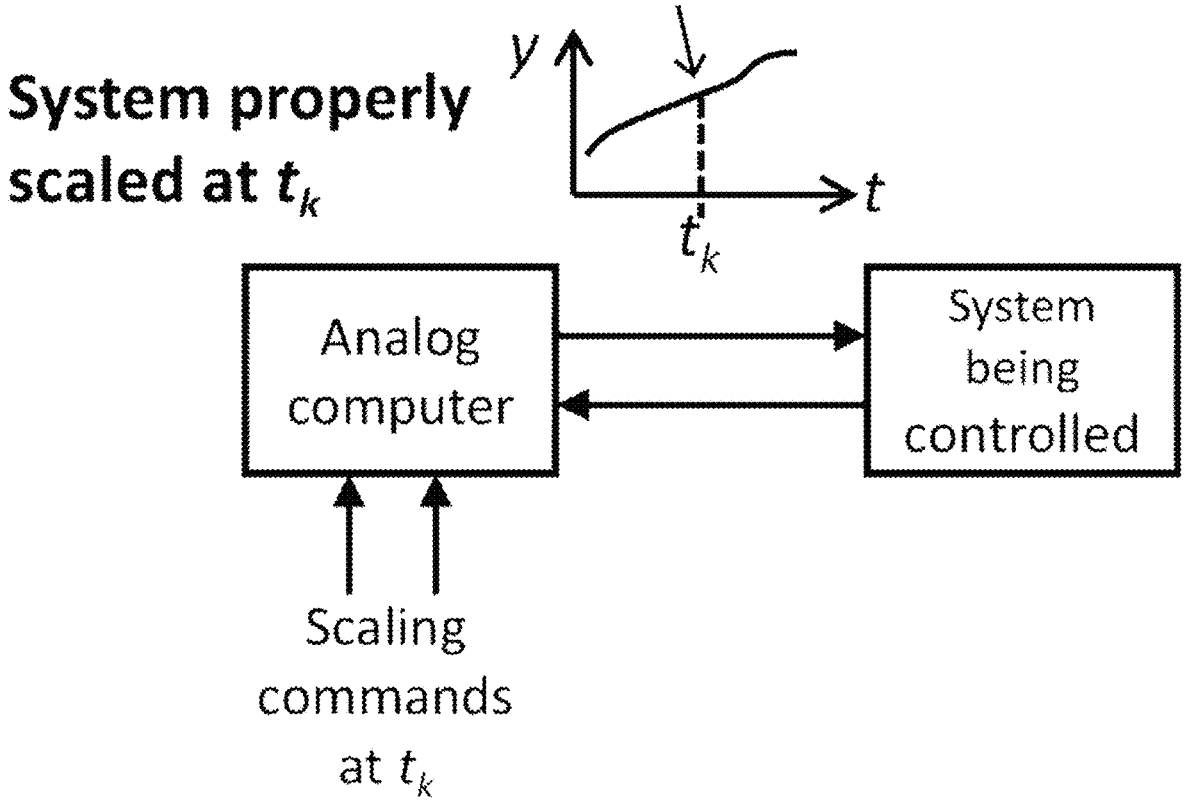
Figure 4A:
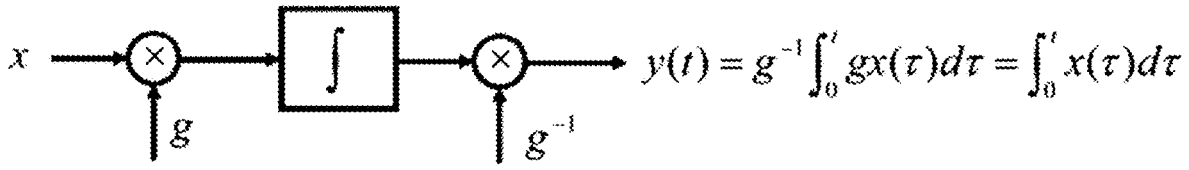
FIGS. 4A and 4B depict, respectively, a typical integrator to be considered for constant integrator input gain g under "0" initial conditions (with the system output y(t) generated as a function of g and $g^{-1}$), and a graphical representation of the changing of constant g over time.
Figure 4B:
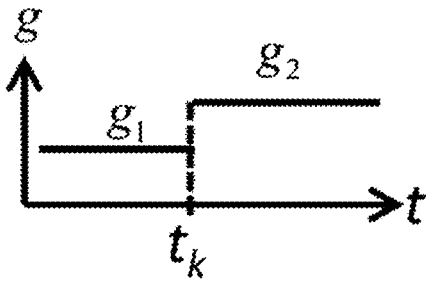

However, if a change in amplitude scaling is needed while a computer is in service, then, while the "before" and "after" scaling may be correct, the transition from the old to the new amplitude-scaling factors (gains) can cause disturbances at the output, thus disrupting system operation. For example, FIG. 3A depicts a simplified system being controlled by an analog computer with an accompanying graph of the analog computer output versus time that does not use amplitude scaling. FIG. 3B depicts a simplified system being controlled by an analog computer with an accompanying graph of the analog computer output versus time that does use amplitude scaling, though the amplitude scaling is "blindly" scaled at some arbitrary time $t_k$. It should be noted that at the point/moment that some scaling is applied, the system gives rise to potentially large perturbations/glitches, which might be solved by momentarily injecting an equal and opposite perturbation at the output, as shown in FIG. 3C, which depicts a simplified system being controlled by an analog computer with an accompanying graph of the analog computer output versus time that does use "proper" amplitude scaling at some time $t_k$. As another example, FIG. 4A depicts a typical integrator to be considered for constant g under "0" initial conditions, with FIG. 4B showing a graphical representation of the changing of constant g over time. The system output y(t) is generated as a function of g and $g^{-1}$ as follows:

$$y(t)=g^{-1}\int_0^1 gx(\tau)\delta\tau=\int_0^1 x(\tau)d\tau$$

Figure 4C:
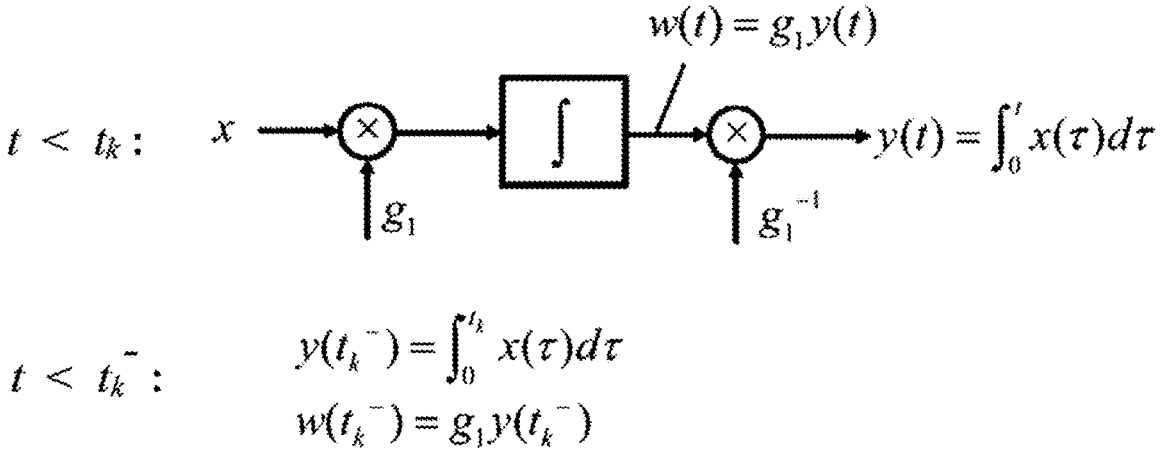
FIG. 4C depicts one embodiment of an improved integrator (and related mathematical functions) that employs dynamic amplitude scaling as a function of the integrator output over time.
Figure 4D:
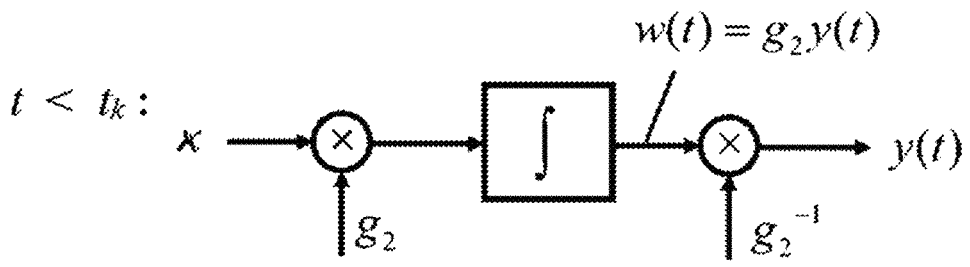
FIG. 4D depicts another embodiment of an improved integrator (and related mathematical functions) that employs dynamic amplitude scaling as a function of the integrator output over time.
Figure 4E:
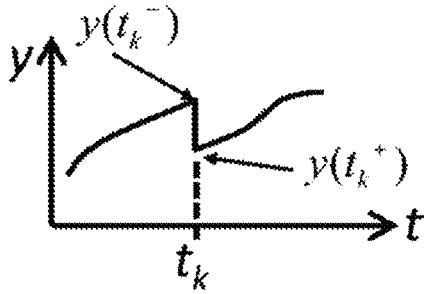
FIG. 4E depicts one embodiment of a graph of a "blind" application of amplitude scaling) as a function of constant g, based on FIGS. 4C and 4D, wherein the output of the integrator is represented by w, and is continuous.

The output of the integrator is represented in FIGS. 4C, 4D, and 4E (with FIG. 4E depicting a graph of a "blind" application of amplitude scaling) as a function of constant g. The output of the integrator is represented by w, and we have:

$$w(t_k^+) = w(t_k^-) = q_1 y(t_k^-)$$

$$y(t_k^+) = q_2^{-1} w(t_k^+) = \frac{q_1}{q_2} y(t_k^-)$$

Thus, the output jumps by:

$$y(t_k^+) - y(t_k^-) = \frac{g_1 - g_2}{g_2} y(t_k^-)$$

Such system disruptions (i.e., output jumps) has been observed in filters. In the prior-art literature, it has been addressed by updating the values of capacitor voltages (for example, see U.S. Pat. No. 5,541,600 to Blumenkrantz). However, a better and more feasable solution is as follows.

Refer to FIGS. 5A through 5E. In this solution, the opposite of the jump is added directly to the output (which is relatively easy, if the signals are currents).

The above requires sampling the output around the time it jumps. To avoid possible complications, the output of the integrator, w, is sampled instead:

Since:

$$w(t_k^-)=g_1 y(t_k^-)$$

Then the following compensation for the disruption can be used to add to the output:

$$\Delta = \frac{g_1 - g_2}{g_2} y(t_k^-) = (g_1^{-1} - g_2^{-1}) w(t_k^-)$$

Figure 5A:
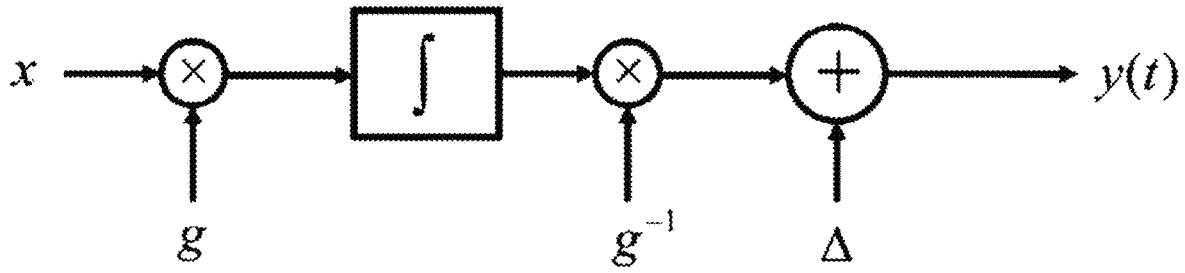
FIG. 5A depicts one embodiment of an improved analog computer that features dynamic amplitude scaling, as well as a means to adjust the output via an additional one-time correction factor added to the analog-computer output y to counter transient perturbances.
Figure 5B:
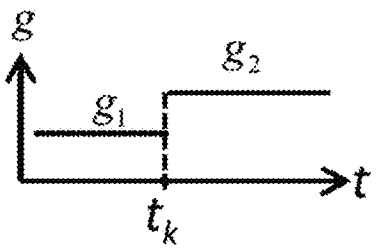
FIGS. 5B, 5C, and 5D each depict a graph of the improved analog computer (from FIG. 5A) output; specifically, where
Figure 5C:
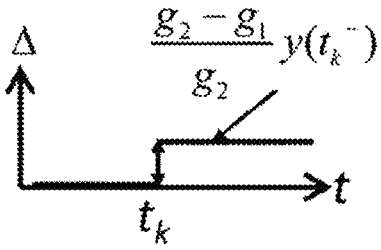
Figure 5D:
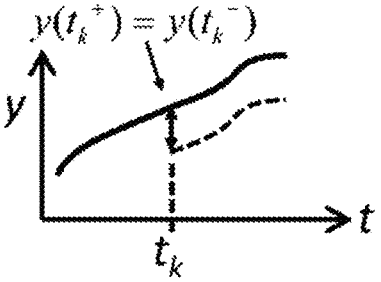
Figure 5E:
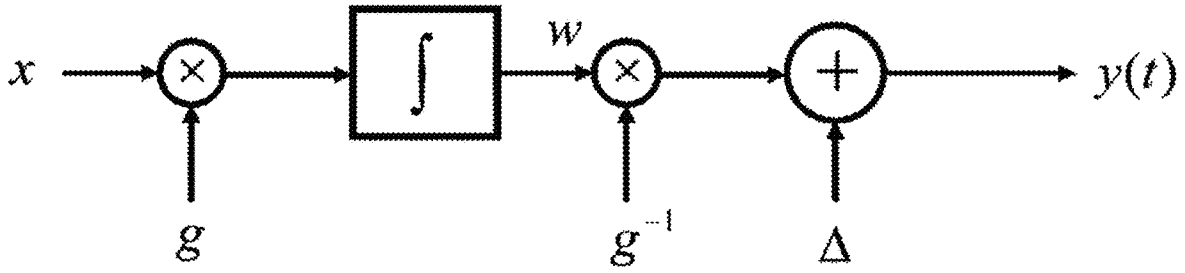
FIG. 5E shows a functional block diagram in which g is inserted at the input of the integrator and in which $g^{-1}$ (the inverse) is inserted at the output thereof.
Figure 5F:
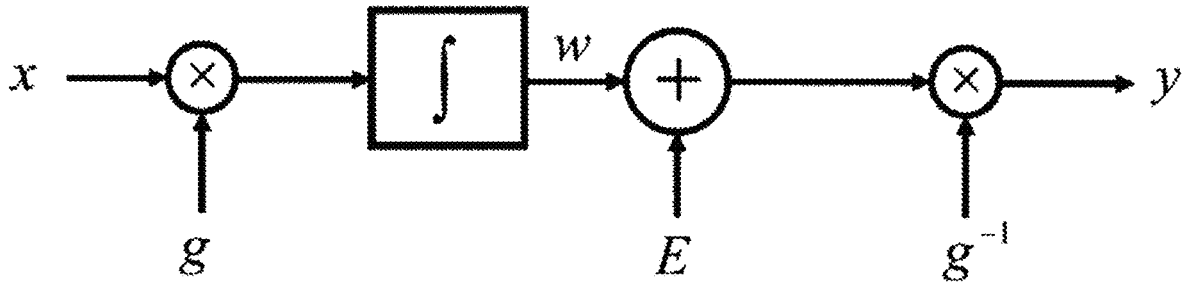
FIG. 5F depicts one embodiment of an improved analog computer that features dynamic amplitude scaling, as well as a means to adjust the output via an additional one-time correction factor added to output w of the integrator of the improved analog-computer to counter transient perturbances.
Figure 5G:
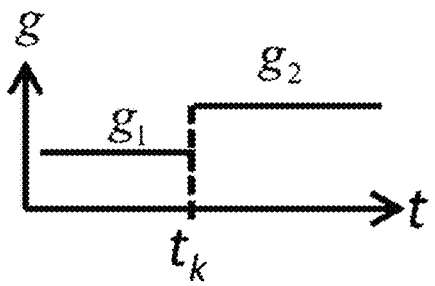
FIGS. 5G, 5H, and 5I each depict a graph of the improved analog computer (from FIG. 5F) output; specifically, where
Figure 5I:
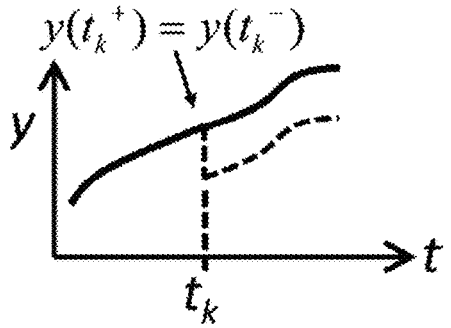
Figure 5H:
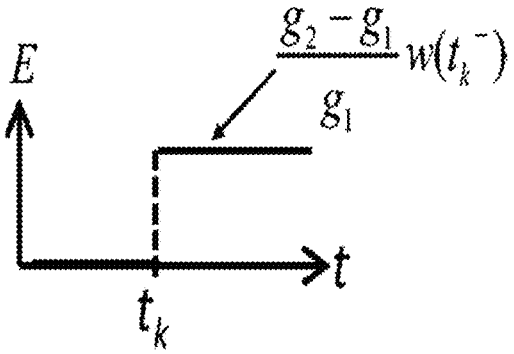

Referring to FIGS. 5F through 5H, in an alternative solution, the compensation for the disruption can be added (E) to the output of the integrator instead.

Figure 6A:
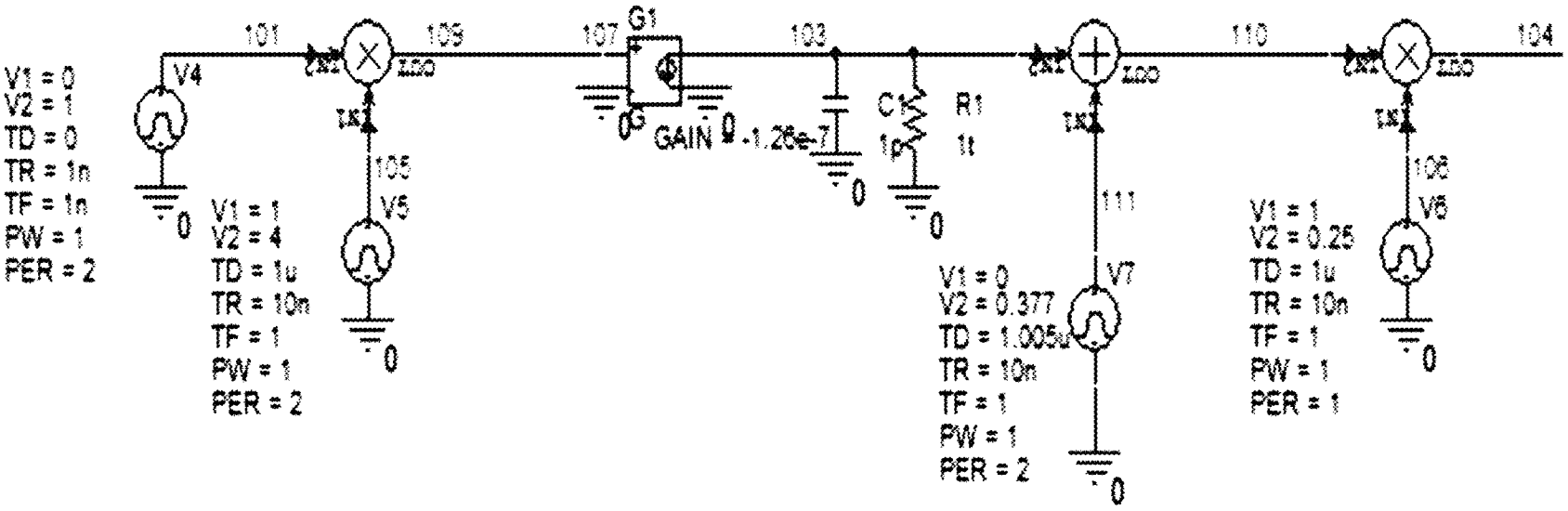
FIG. 6A depicts one in principle embodiment of one example schematic of an improved integrator for use in an improved analog computer, which was generated with a simulated program for integrated circuits emphasis (SPICE) with various enumerated points used for analysis.

FIG. 6A depicts one example integrator schematic developed with a simulated program for integrated circuits emphasis (SPICE) representing the integrator in an improved analog computer that features dynamic amplitude scaling, with various enumerated points (101, 103, 104, 105, 106, 107, 109, 110, and 111) used for study.

Figure 6B:
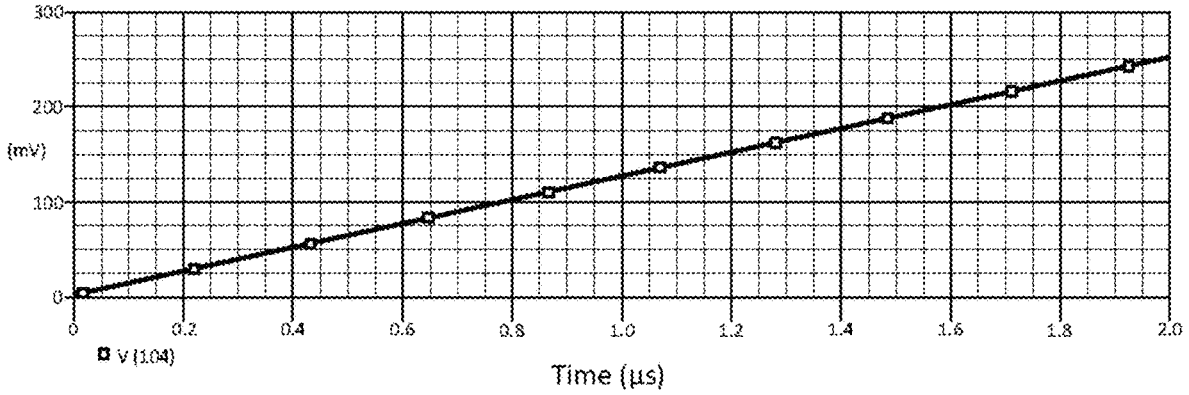
FIGS. 6B, 6C, and 6D provides various graphs of concurrent integrator measurements versus time, each graph over the same time scale.

FIG. 6B graphs the integrator output 104 versus time, based on a 20-kHz unity-gain frequency, a constant g=1, and a unit step input.

Figure 6C:
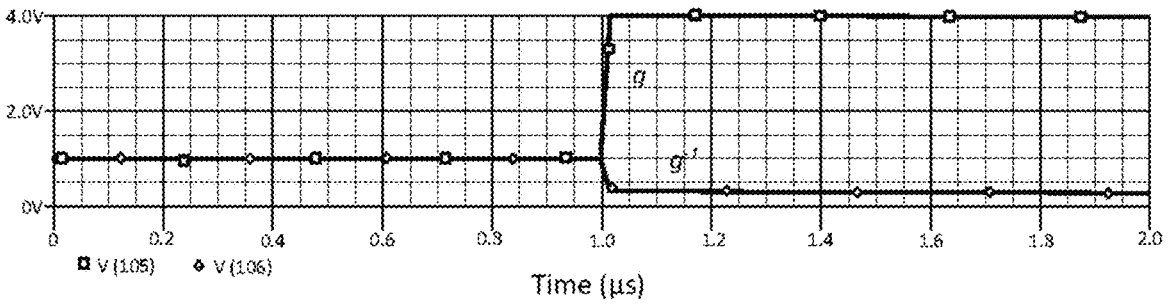
Figure 6D:
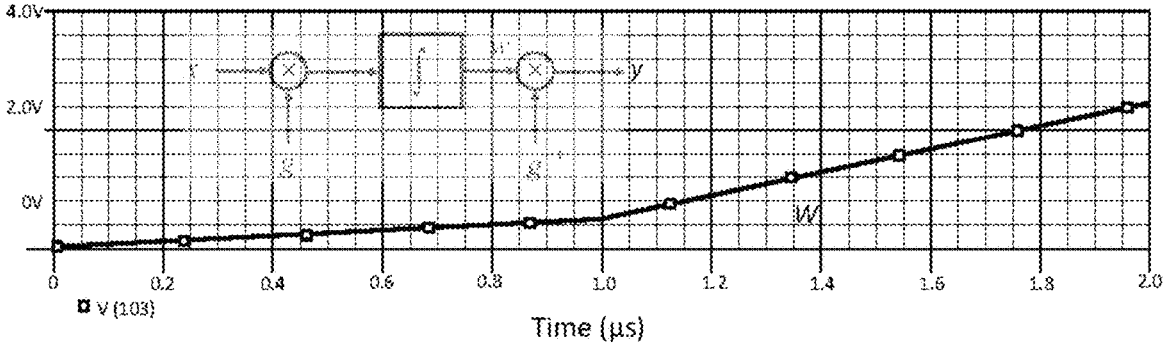
Figure 6E:
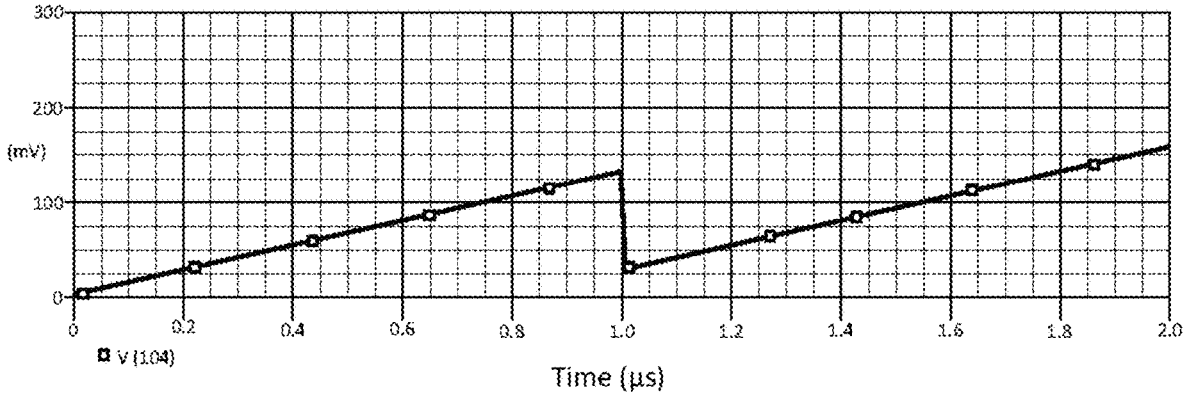
FIGS. 6E, 6F, 6G, and 6H provides various graphs of concurrent integrator measurements versus time, each graph over the same time scale, after a "jump" or system perturbation is introduced.

FIGS. 6C through 6E depict the integrator with implementing variable gain g, $g^{-1}$. It should be noted that the gains are given significant rise time, in order to observe the effect at nodes 103, 104, and 106 and on the integrator output w and system output y.

Figure 6F:
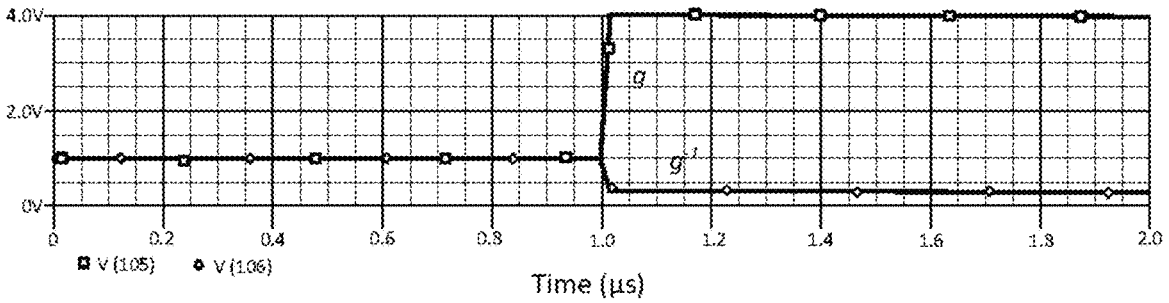
Figure 6G:
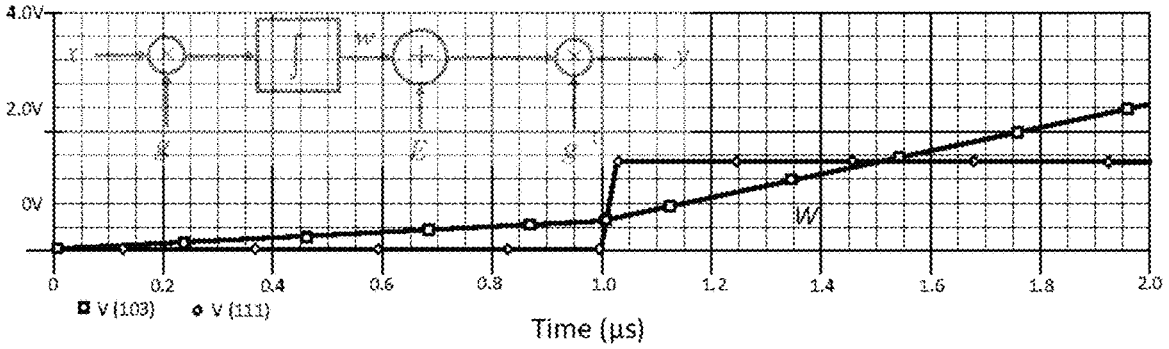
Figure 6H:
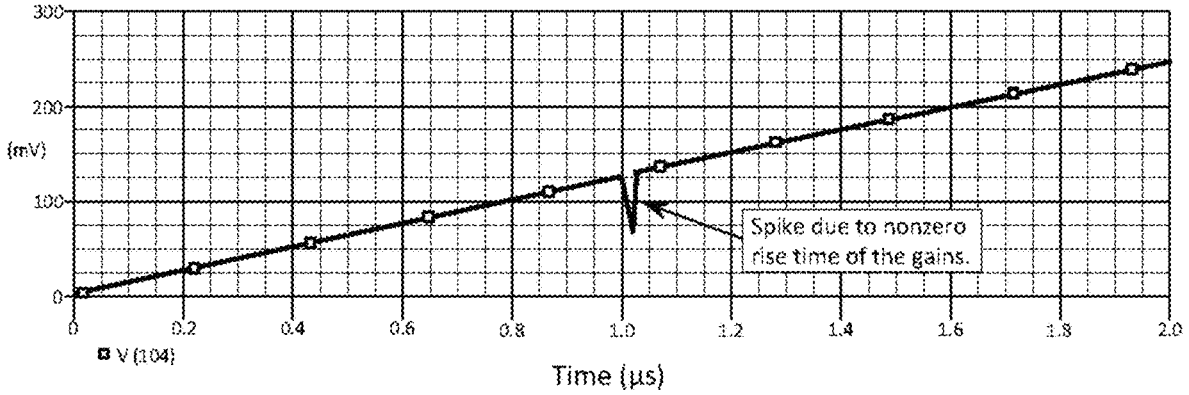
Figure 6I:
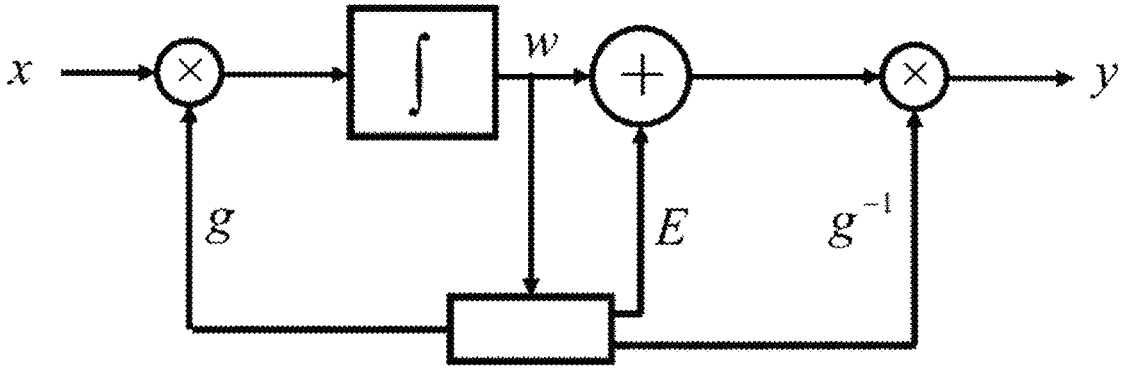
FIG. 6I depicts one embodiment of a simplified diagram of an improved analog computer that incorporates an improved integrator.

A "jump" correction E may be added, as depicted in FIG. 5F. Output profiles at various enumerated nodes (103, 104, 105, 106, 111 for the integrator output w and system output y) are depicted in FIGS. 6F through 6H. The gains are given significant rise time. However, it should be noted in FIG. 6H that the "glitch" (or perturbation) in the integrator voltage output profile shown at t=1.0 μs is due to the nonzero rise time of the gains g, $g^{-1}$. The glitch can be managed by adjusting the various time delays. In addition, such glitches are present also due to the digital-to-analog converter (DAC). A corrective technique requires knowledge of w (or y) a moment before switching the gain, in order to generate the correction term E. To retain, and operate on, the sample of w, the control box (see FIG. 6I) needs to contain a sample-and-hold circuit or an analog-to-digital-converter (ADC)—digital-to-analog-converter (DAC) combination. While multiplier factors (gains) can be used that are inverses of each other as an example, this does not have to be the case, if it is desired to change the overall gain constant. The aforementioned technique described deals with a way to change the output coefficient w without disturbances, independent of what the input coefficient x is.

The above-discussed principles can be generalized to linear analog computers with:

Arbitrary topologies;

Gains that depend not only on one, but on multiple integrator outputs; and

Arbitrary g shapes (even continuously varying).

Such implementations can be accomplished by applying to the analog computer earlier results as discussed in the following prior-art references, which were created by the same Inventor as for the present patent application, and which are hereby incorporated by reference:

Y. Tsividis, "Externally linear, time-invariant systems and their application to companding signal processors", IEEE Transactions on Circuits and Systems, Part II, vol. 44, no. 2, pp. 65-85, February 1997; and U.S. Pat. No. 6,389,445, "Methods and Systems for Designing and Making Signal-Processor Circuits With Internal Companding, and the Resulting Circuits," Yannis Tsividis.

Figure 7A:
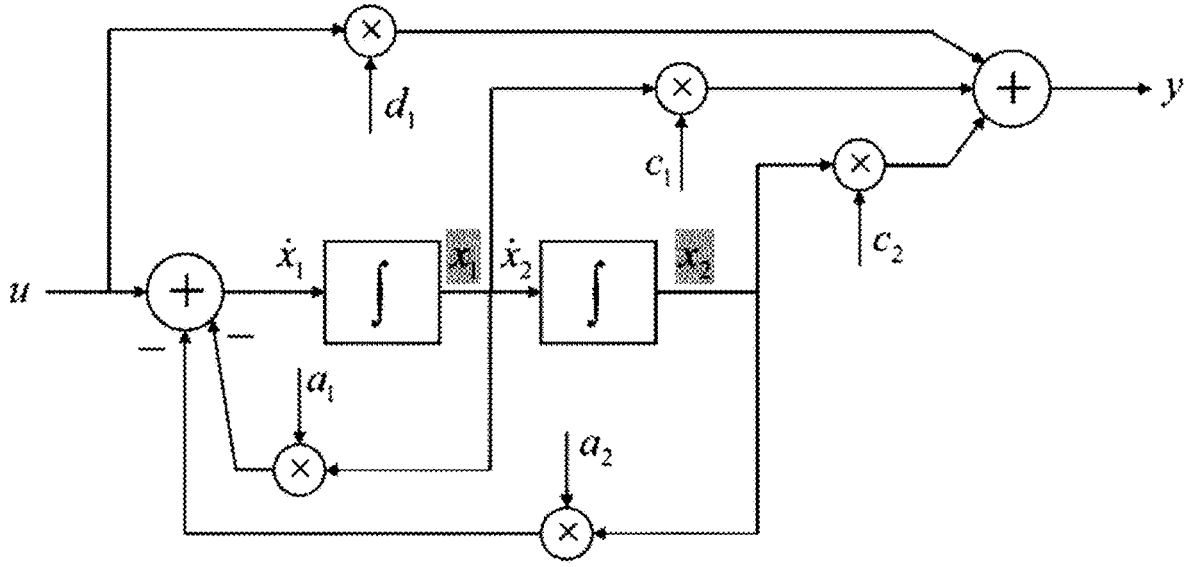
FIG. 7A depicts one embodiment of a dual-integrator analog computer (AC).
Figure 7B:
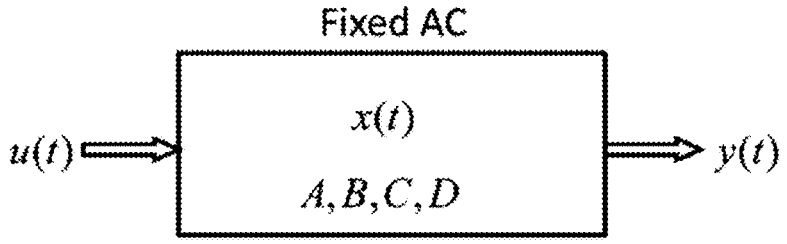
FIG. 7B depicts one embodiment of a simplified representation of a fixed analog computer (AC).
Figure 7C:
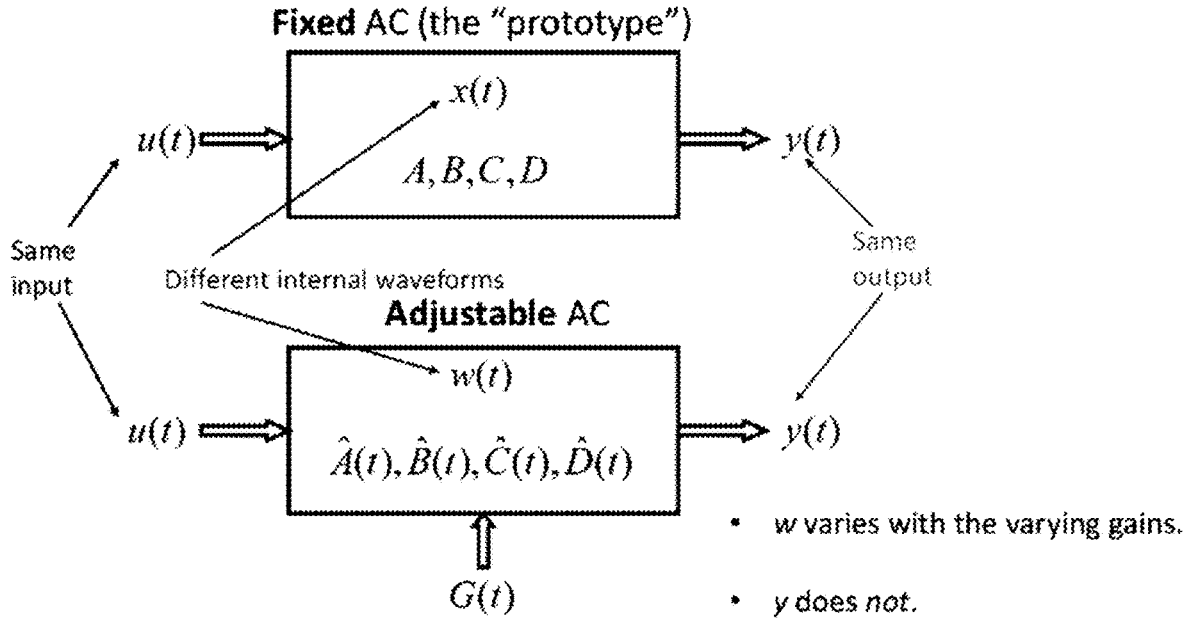
FIG. 7C depicts one embodiment of simplified representations of a fixed analog computer (AC) (from FIG. 7B) and of an adjustable analog computer (AC) for purposes of comparison.

Refer to FIGS. 7A through 7C. As a preliminary matter, the state of the integrator outputs need to be determined. If those are known, then all of the other variables can be evaluated. The first derivatives of the states and the output are expressed as follows:

$$\dot{x}_1=-a_1x_1-a_2x_2+u$$

$$\dot{x}_2=x_1$$

$$y=c_1x_1+c_2x_2+d_1u$$

This can also be expressed in matrix form:

$$\begin{bmatrix} \dot{x}_1 \\ \dot{x}_2 \end{bmatrix} = \begin{bmatrix} -a_1 & 1a_2 \\ 1 & 0 \end{bmatrix} \begin{bmatrix} x_1 \\ x_2 \end{bmatrix} + \begin{bmatrix} 1 \\ 0 \end{bmatrix} u$$

$$y = [c_1 \ c_2] \begin{bmatrix} x_1 \\ x_2 \end{bmatrix} + d_1 u$$

These are of the form:

$$\dot{x} = Ax + Bu$$

$$y = Cx + Du$$

Where:

$$x = \begin{bmatrix} x_1 \\ x_2 \end{bmatrix}$$

$$A = \begin{bmatrix} -a_1 & -a_2 \\ 1 & 0 \end{bmatrix}$$

$$B = \begin{bmatrix} 1 \\ 0 \end{bmatrix}$$

$$C = [c_1 \ c_2]$$

$$D = d_1$$

As was developed in the two references cited earlier, in general, any linear implementation on the analog computer can be described by state equations:

$$\dot{x}(t) = Ax(t) + Bu(t)$$

$$y(t) = Cx(t) + Du(t)$$

Where:

x is the vector of all integrator outputs;

u is the vector of all inputs;

y is the vector of the analog computer's outputs; and

A, B, C, and D are appropriate matrices.

These state equations can be applied to dynamic amplitude scaling, and can also be written for nonlinear systems. In FIGS. 7A, 7B, and 7C, w varies with the varying gains, but y does not. This can be done by appropriately choosing the hatted matrices.

This is accomplished by starting with a linear-time-invariant (LTI) prototype:

$$\dot{x}(t) = Ax(t) + Bu(t)$$

$$y(t) = Cx(t) + Du(t)$$

Consider a linear-time-varying (LTV) system:

$$\dot{w}(t) = \hat{A}(t)w(t) + \hat{B}(t)u(t)$$

$$\hat{y}(t) = \hat{C}(t)w(t) + \hat{D}(t)u(t)$$

The actual physical analog-computing system is required to have, for the same input, the same output as the prototype:

$$\hat{y}(t) = y(t), \text{all } t$$

Whereas, its state variables are "scaled" according to a gain matrix G(t):

$$w(t) = G(t)x(t)$$

Direct substitution shows that for the above equations to be satisfied the following is required:

$$\hat{A}(t) = \dot{G}(t)G^{-1}(t) + G(t)AG^{-1}(t)$$

$$\hat{B}(t) = G(t)B$$

$$\hat{C}(t) = CG^{-1}(t)$$

$$\hat{D}(t) = D$$

These are linear transformations that convert the original, time-invariant analog computer to a time-varying one. This allows the internal waveforms to be amplitude-scaled, without any transients at the output. However, unfortunately, practical implementation is difficult. This technique is valid for linear equations only. Scaling for nonlinear cases is tricky and case-dependent.

CONCLUSIONS

Gain adjustments are important for optimizing the input-output performance of analog-computer circuits that have, by themselves, severe linearity and noise limitations. When it is attempted to vary gains while the analog computer is in service, output disturbances occur. Such disturbances can be large, and are likely to interfere with proper operation in the case of real-time control. A simple technique for eliminating such disturbances in the case of an integrator has been presented in the above discussion. In addition, related results have been adapted from linear systems theory and have been reviewed. Gain adjustment has the potential of drastic power reduction for a given signal-to-noise ration (SNR), if implemented successfully.

III. Alternative Embodiments and Other Variations

The various embodiments and variations thereof described herein, including the descriptions in any appended Claims and/or illustrated in the accompanying Figures, are merely exemplary and are not meant to limit the scope of the inventive disclosure. It should be appreciated that numerous variations of the invention have been contemplated as would be obvious to one of ordinary skill in the art with the benefit of this disclosure.

Hence, the alert reader will have no difficulty devising myriad obvious variations and improvements to the invention, all of which are intended to be encompassed within the scope of the Description, Figures, and Claims herein.

What is claimed is:

1. A method for operating a physical analog computer adapted to receive and process at least one input signal, the physical analog computer defining an integrator downstream of said at least one input signal and further defining an output downstream of said integrator, the method comprising the steps of:

applying a first change to a scaling value at the at least one input signal responsive to an increase or a decrease in a magnitude of the at least one input signal;

and in response to any change in the scaling value:

dynamically calculating a first one-time correction factor based upon the magnitude of the first change to the scaling value; and at the integrator, injecting the first one-time correction factor to the integrator with an adder, the timing and magnitude of the first one-time correction factor selected to reduce any perturbation that would be observed at the output in the absence of the injection of the first one-time correction factor.

2. The method of claim 1 wherein the application of a first change to the scaling value at the at least one input signal is an increase in the scaling value in response to an increase in a magnitude of the at least one input signal.

3. The method of claim 1 wherein the application of a first change to the scaling value at the at least one input signal is a decrease in the scaling value in response to a decrease in a magnitude of the at least one input signal.

4. The method of claim 1 wherein the selection of the timing and magnitude of the first one-time correction factor are carried out by means of digital computation running in parallel with any analog computation carried out by the physical analog computer.

5. The method of claim 1 wherein the changing of the scaling value at the least one input signal is determined by means of digital computation running in parallel with any analog computation carried out by the physical analog computer.

6. The method of claim 1 further comprising the steps, carried out after the steps of applying a first change to a scaling value and injecting a first one-time correction factor, of:

applying a second change to the scaling value at the at least one input signal;

at the integrator, injecting a second one-time correction factor to the integrator with an adder, the timing and magnitude of the second one-time correction factor selected to reduce any perturbation that would be observed at the output in the absence of the injection of the second one-time correction factor.

7. The method of claim 6 wherein the second change to the scaling value is in a different direction than the first change to the scaling value.

8. The method of claim 6 wherein the second change to the scaling value is in the same direction as the first change to the scaling value.

9. A physical analog computer adapted to receive and process at least one input signal, the physical analog computer defining an integrator downstream of said at least one input signal and further defining an output downstream of said integrator, the analog computer further comprising:

first means responsive to increases and decreases in a magnitude of the at least one input signal for applying a first change to a scaling value at the at least one input signal;

second means, responsive to any change to the scaling value, for selecting a timing and magnitude of a one-time correction factor for injection at an output of the integrator, the timing and magnitude of the first one-time correction factor selected to reduce any perturbation that would be observed at the output in the absence of the injection of the first one-time correction factor, and an adder which injects the one-time correction factor at the integrator, wherein the first one-time correction factor is dynamically calculated based on the magnitude of the first change to the scaling value.

10. The analog computer of claim 9 wherein the selection of the timing and magnitude of the first one-time correction factor are carried out by means of digital computation running in parallel with any analog computation carried out by the physical analog computer.

11. The analog computer of claim 9 wherein the changing of the scaling value at the least one input signal is determined by means of digital computation running in parallel with any analog computation carried out by the physical analog computer.

12. A method for operating a physical analog computer adapted to receive and process at least one input signal, the physical analog computer defining an integrator downstream of said at least one input signal and further defining an output downstream of said integrator, the method comprising the steps of:

applying a first change to a scaling value at the at least one input signal;

at the integrator, injecting a first one-time correction factor to the integrator with an adder, the timing and magnitude of the first one-time correction factor selected to reduce any perturbation that would be observed at the output in the absence of the injection of the first one-time correction factor;

wherein the application of a first change to the scaling value at the at least one input signal is an increase in the scaling value in response to an increase in a magnitude of the at least one input signal.

13. The method of claim 12 wherein the selection of the timing and magnitude of the first one-time correction factor are carried out by means of digital computation running in parallel with any analog computation carried out by the physical analog computer.

14. The method of claim 12 wherein the changing of the scaling value at the least one input signal is determined by means of digital computation running in parallel with any analog computation carried out by the physical analog computer.

15. The method of claim 12 further comprising the steps, carried out after the steps of applying a first change to a scaling value and injecting a first one-time correction factor, of:

applying a second change to the scaling value at the at least one input signal;

at the integrator, injecting a second one-time correction factor to the integrator, the timing and magnitude of the second one-time correction factor selected to reduce any perturbation that would be observed at the output in the absence of the injection of the second one-time correction factor.

16. The method of claim 15 wherein the second change to the scaling value is in a different direction than the first change to the scaling value.

17. The method of claim 15 wherein the second change to the scaling value is in the same direction as the first change to the scaling value.

18. A method for operating a physical analog computer adapted to receive and process at least one input signal, the physical analog computer defining an integrator downstream of said at least one input signal and further defining an output downstream of said integrator, the method comprising the steps of:

applying a first change to a scaling value at the at least one input signal;

at the integrator, injecting a first one-time correction factor to the integrator with an adder, the timing and magnitude of the first one-time correction factor selected to reduce any perturbation that would be observed at the output in the absence of the injection of the first one-time compensation factor;

wherein the application of a first change to the scaling value at the at least one input signal is a decrease in the scaling value in response to a decrease in a magnitude of the at least one input signal.

19. The method of claim 18 wherein the selection of the timing and magnitude of the first one-time correction factor are carried out by means of digital computation running in parallel with any analog computation carried out by the physical analog computer.

20. The method of claim 18 wherein the changing of the scaling value at the least one input signal is determined by means of digital computation running in parallel with any analog computation carried out by the physical analog computer.

21. The method of claim 18 further comprising the steps, carried out after the steps of applying a first change to a scaling value and injecting a first one-time correction factor, of:

applying a second change to the scaling value at the at least one input signal;

at the integrator, injecting a second one-time correction factor to the integrator, the timing and magnitude of the second one-time correction factor selected to reduce any perturbation that would be observed at the output in the absence of the injection of the second one-time correction factor.

22. The method of claim 21 wherein the second change to the scaling value is in a different direction than the first change to the scaling value.

23. The method of claim 21 wherein the second change to the scaling value is in the same direction as the first change to the scaling value.

24. A method for operating a physical analog computer adapted to receive and process at least one input signal, the physical analog computer defining an integrator downstream of said at least one input signal and further defining an output downstream of said integrator, the method comprising the steps of:

applying a first change to a scaling value at the at least one input signal;

at the integrator, injecting a first one-time correction factor to the integrator with an adder, the timing and magnitude of the first one-time correction factor selected to reduce any perturbation that would be observed at the output in the absence of the injection of the first one-time correction factor, further comprising the steps, carried out after the steps of applying a first change to a scaling value and injecting a first one-time correction factor, of:

applying a second change to the scaling value at the at least one input signal;

at the integrator, injecting a second one-time correction factor to the integrator with the adder, the timing and magnitude of the second one-time correction factor selected to reduce any perturbation that would be observed at the output in the absence of the injection of the second one-time correction factor, wherein the second change to the scaling value is in the same direction as the first change to the scaling value.

25. The method of claim 24 wherein the application of a first change to the scaling value at the at least one input signal is an increase in the scaling value in response to an increase in a magnitude of the at least one input signal.

26. The method of claim 24 wherein the application of a first change to the scaling value at the at least one input signal is a decrease in the scaling value in response to a decrease in a magnitude of the at least one input signal.

27. The method of claim 24 wherein the selection of the timing and magnitude of the first one-time correction factor are carried out by means of digital computation running in parallel with any analog computation carried out by the physical analog computer.

28. The method of claim 24 wherein the changing of the scaling value at the least one input signal is determined by means of digital computation running in parallel with any analog computation carried out by the physical analog computer.

* * * * *